US006103983A

United States Patent [19]

Truchet et al.

[11] Patent Number: 6,103,983

[45] Date of Patent: Aug. 15, 2000

[54] SYSTEM FOR MANUALLY CONTROLLING AN ELECTRIC SWITCHING MEMBER

[75] Inventors: Bernard Truchet, Besayes; Francis Fernandez; Jean-Marie Vergnes, both of Valence, all of France

[73] Assignee: Crouzet Automatismes, Valence, France

[21] Appl. No.: 09/147,223

[22] PCT Filed: Apr. 30, 1997

[86] PCT No.: PCT/FR97/00765

§ 371 Date: Oct. 30, 1998

§ 102(e) Date: Oct. 30, 1998

[87] PCT Pub. No.: WO97/41580

PCT Pub. Date: Nov. 6, 1997

[30] Foreign Application Priority Data

Apr. 30, 1996 [FR] France ..... 96 05427

[51] Int. Cl.[7] ..... H01H 13/56

[52] U.S. Cl. ..... 200/523

[58] Field of Search ..... 200/520, 536, 200/329–348, 318–327

[56] References Cited

U.S. PATENT DOCUMENTS 5,128,647 7/1992 Truchet ..... 200/539 X 5,257,001 10/1993 Truchet et al. ..... 337/57

5,264,818 11/1993 Truchet et al. ..... 337/79

5,426,274 6/1995 Bruggemann et al. ..... 200/523

FOREIGN PATENT DOCUMENTS

3243638 A1 6/1983 Germany ..... H01H 13/64

4301213 C1 5/1994 Germany ..... H01H 13/56

*Primary Examiner*—J. R. Scott

*Attorney, Agent, or Firm*—Oblon, Spivak, McClelland, Maier & Neustadt, P.C.

[57] ABSTRACT

A mechanism for manually controlling an electric switching member includes a control button, a guide for guiding the movement of a moving element of the switching member, and a link which moves longitudinally in the direction of travel of the control button and laterally into an abutting position which prevents longitudinal movement of the link. The mechanism further includes an element secured to the control button and configured to contact the link to cause the longitudinal movement of the link, a first spring configured to push the control button into a pulled-out position, a second return spring configured to push the link out of the abutting position, and a cylindrical bushing in which the control button slides.

20 Claims, 8 Drawing Sheets

FIG. 3c
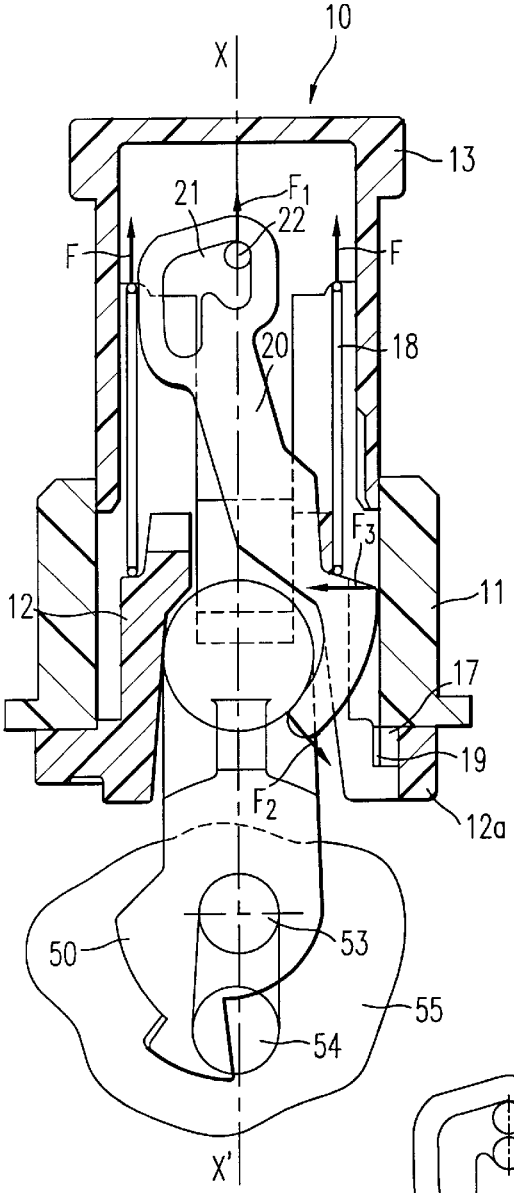
FIG. 4
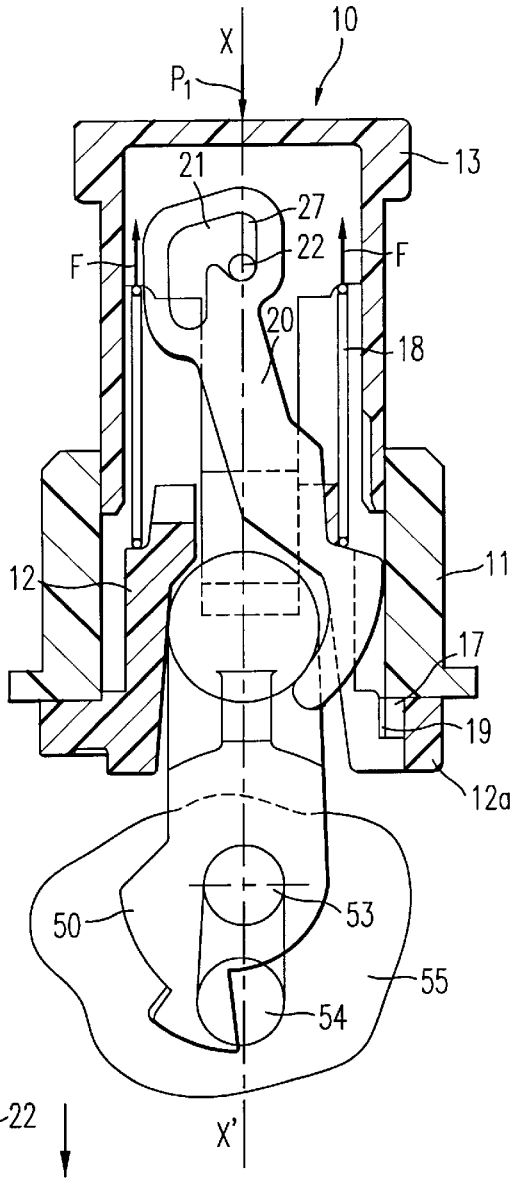
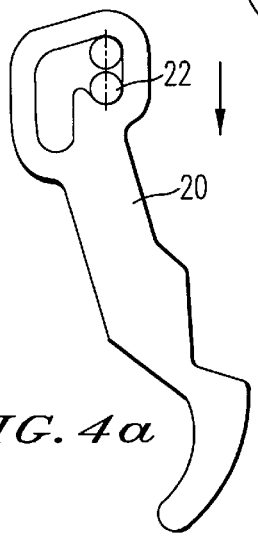
FIG. 4a

FIG. 5
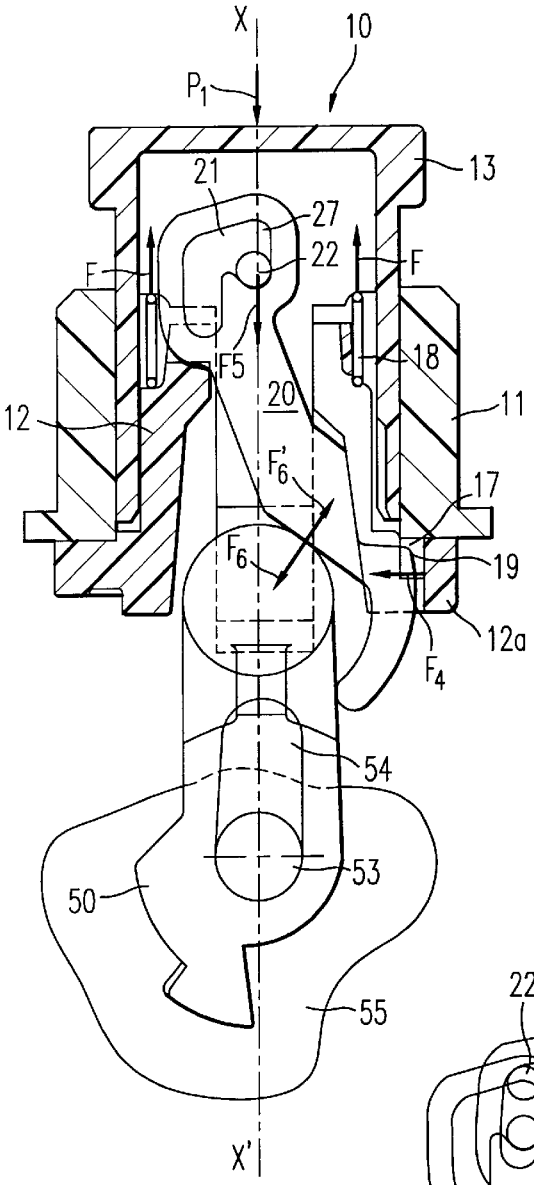
FIG. 6
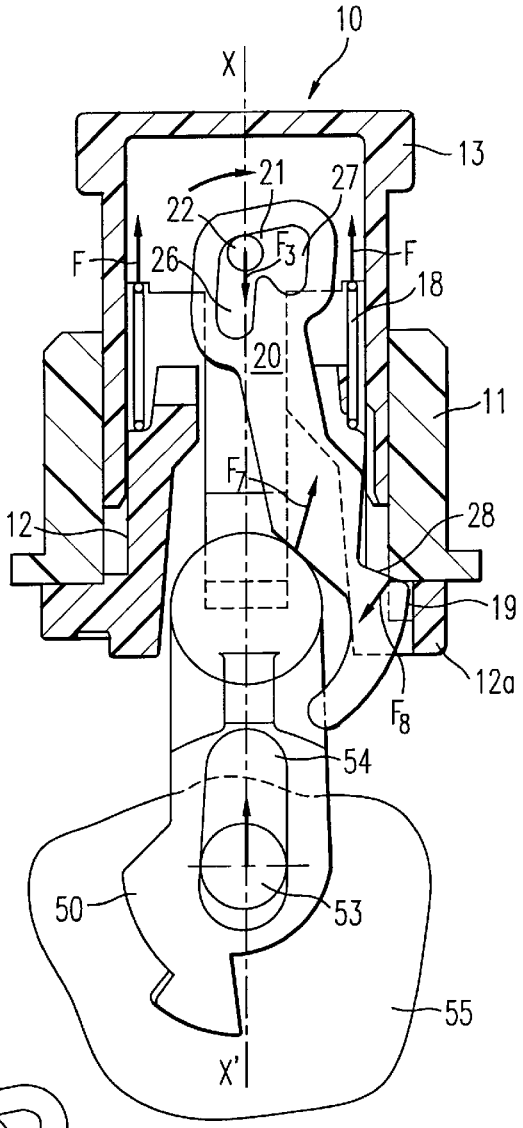
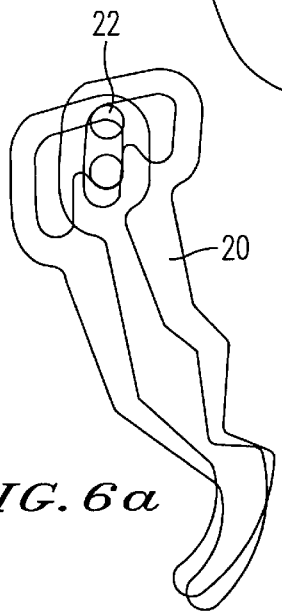
FIG. 6a

FIG. 7
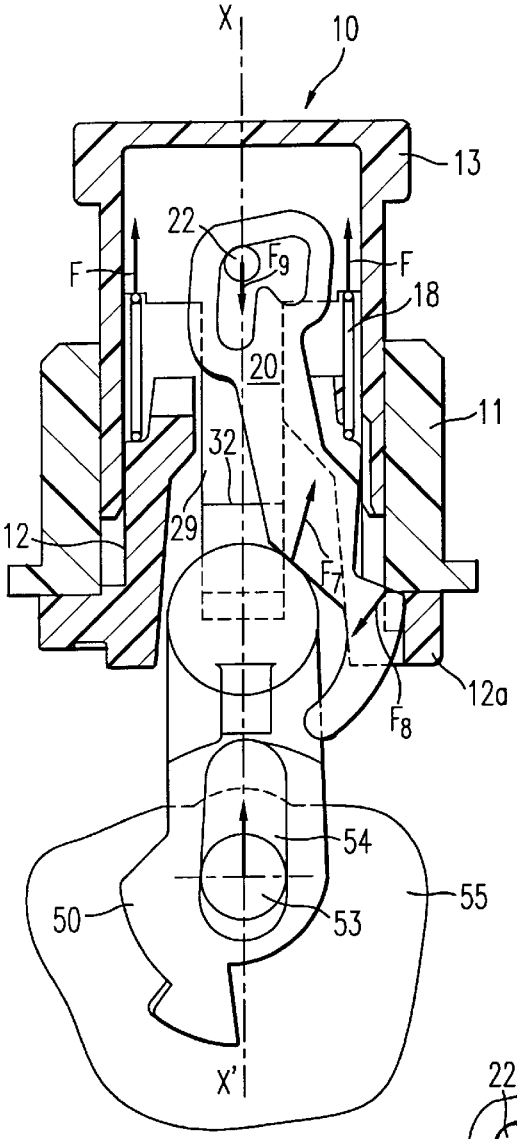
FIG. 10
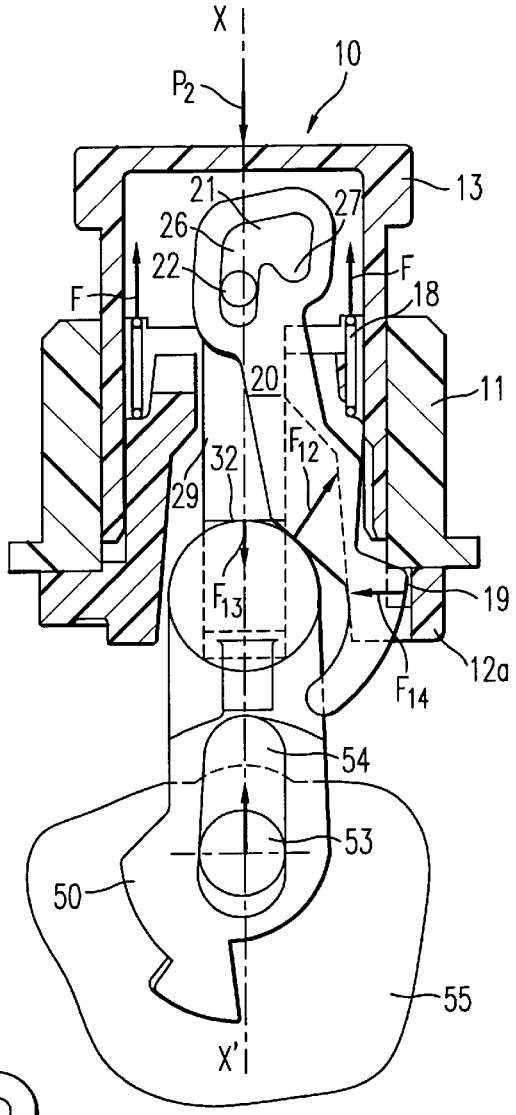
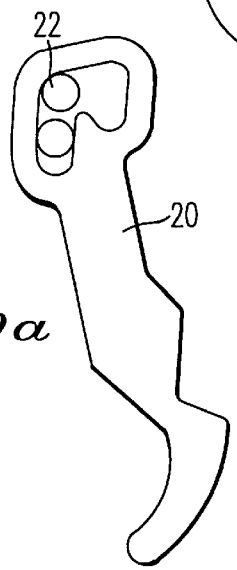
FIG. 10a

FIG. 8
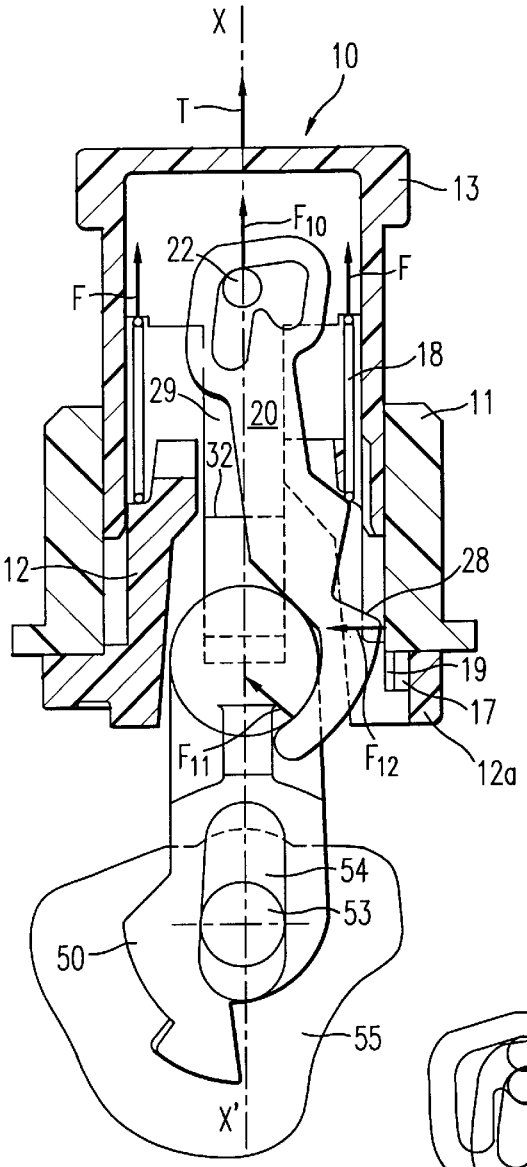
FIG. 9
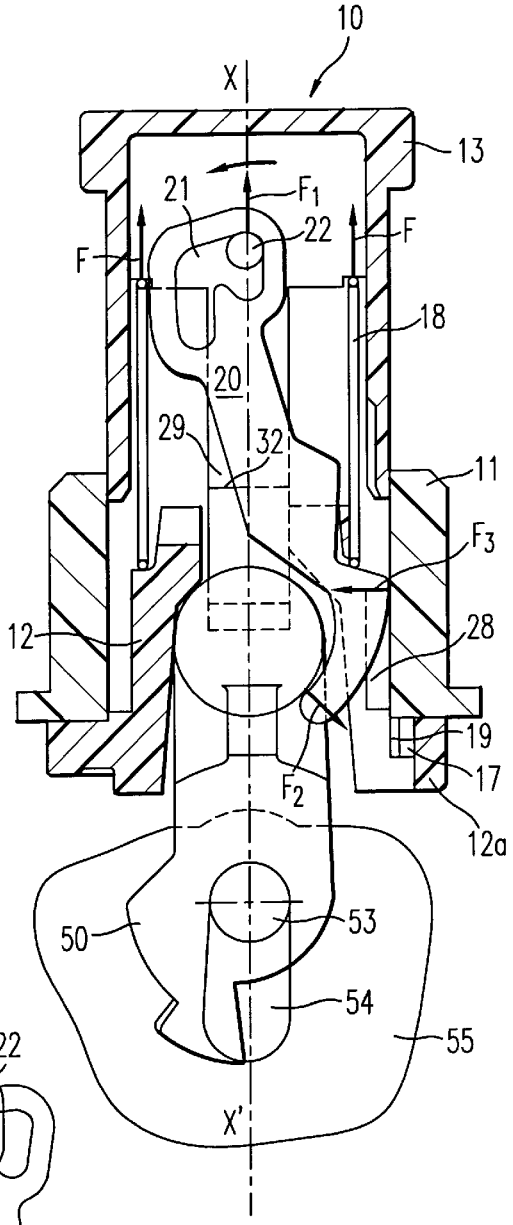
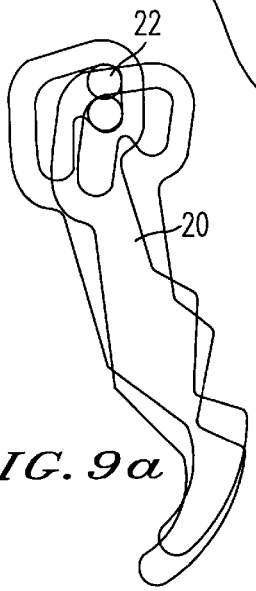
FIG. 9a

FIG. 11
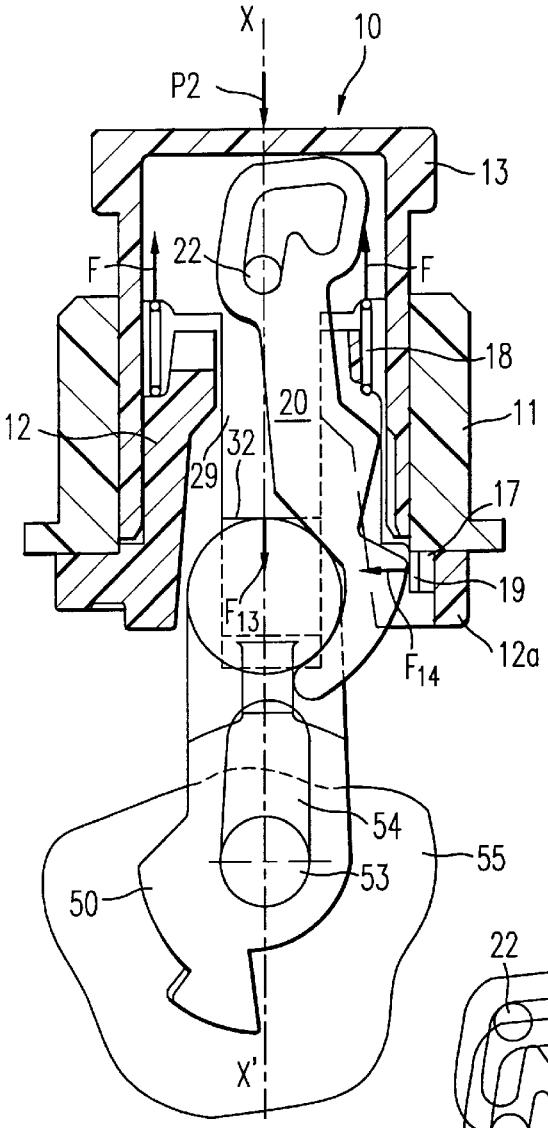
FIG. 12
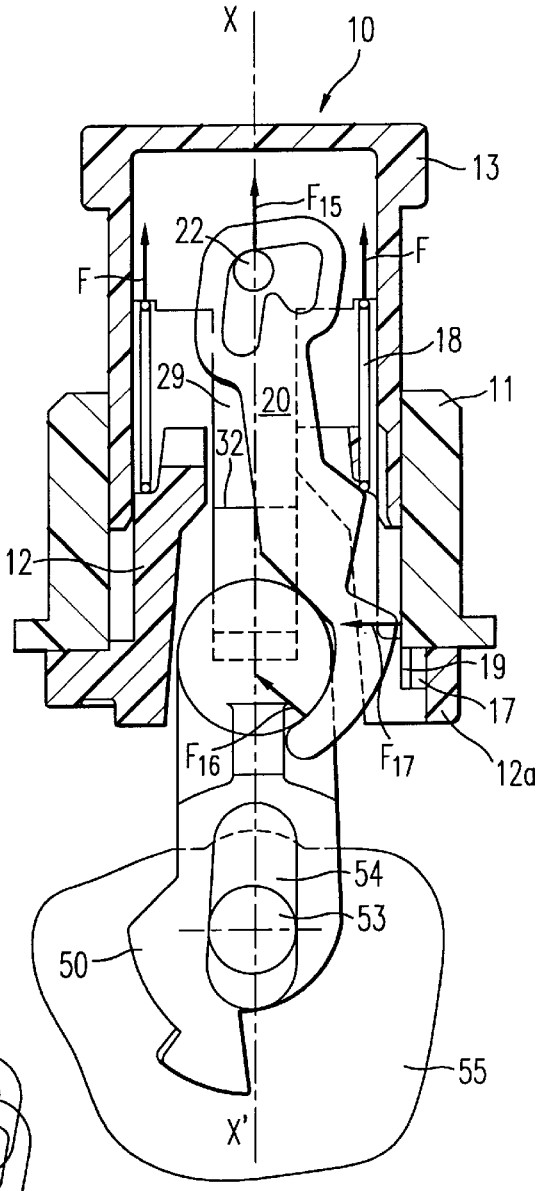
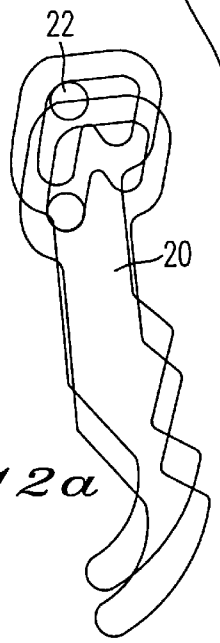
FIG. 12a

SYSTEM FOR MANUALLY CONTROLLING AN ELECTRIC SWITCHING MEMBER

BACKGROUND OF THE INVENTION

Field of the Invention

The present invention relates to manually operated mechanisms controlling the opening or closing of electric switching members (on-off switches, etc.), especially circuit breakers.

These mechanisms in general make it possible to perform switching in one direction by pushing-in a control button and to disengage switching in the other direction by acting either on the same control button or on another button.

In the case of circuit breakers, disengagement in the other direction, when the same button is used, is theoretically achieved by pulling on the pushed-in button; the pulled-out position is in any case the one to which the button returns automatically when the circuit is broken. However, in the case of on-off switches, disengagement usually is achieved by pushing the pushed-in button in again, the button then coming free and being able to return to its position of rest (push-button action).

Under certain conditions, these types of action are not the most practical to use and it may be preferable, for example, for disengagement of a circuit breaker to be achieved by pushing the pushed-in button in again. This is the case, for example, with circuit breakers placed in a very confined space such as the cockpit of an aircraft. However, the solution that consists in replacing within a circuit breaker the button that can be disengaged by pulling with a pushbutton of the "on-off switch" type is only partially satisfactory because it entails a movement that is the opposite of what the user is accustomed to performing in the case of a circuit breaker.

SUMMARY OF THE INVENTION

In order to alleviate this drawback, the invention proposes a new mechanism for manual operation which can be used for a circuit breaker but which can also be adapted to an on-off switch or any other type of electric switching member. This mechanism comprises a minimum number of parts and has a low manufacturing cost.

To achieve this, the invention proposes a system for manually controlling an electric switching member, comprising a control button, a guide for the movement of a moving element of the switching member, the moving element being able to move between a position of rest and a work position, the control button being able to move between a stable pushed-in position and a stable pulled-out position, a mechanism such that an action of pushing on the button when it is in the pushed-in position causes a change from the work position to the position of rest and a return of the button to the pulled-out position, and such that an action of pulling on the button when it is in the pushed-in position also causes a change from the work position to the position of rest and the return of the button to the pulled-out position, characterized in that the mechanism comprises:

- a link which moves longitudinally in the direction of travel of the control button, which can also tilt into an abutting position which prevents its longitudinal movement and which can finally be made to move longitudinally;
- an element secured to the control button and causing the longitudinal movement of the link;
- a first spring allowing the control button to be returned to its pulled-out position;

- a second return spring allowing the link to be pushed back out of its abutting position;
- a cylindrical bushing in which the control button slides.

It will be noted that patent DE 4301213 has already proposed a switch which, having been actuated into the work position by a control button, can return to a position of rest, either by pushing it again, or by pulling on the control button, the latter action being considered as a wrong move and return to a position of rest serving merely to prevent damage to the mechanism when the user erroneously pulls on the control button.

The control mechanisms of the prior art are adapted to a single type of switching member; they are complicated and expensive and make no attempt to secure the return of the switching member to the position of rest in normal operation either by pushing or by pulling the control button.

The mechanism proposed by the invention has the advantage of comprising a minimum number of mechanical parts and of being of a low manufacturing cost.

The link is shaped in such a way as to push the switching member towards its work position or as to pull it towards its position of rest.

The link remains jammed in its abutting position by a moving element of the switching member which presses against the link when this member is in its work position.

The link can come free of its abutting position by pushing on the button, which then presses directly on the moving element of the switching member, which then stops exerting pressure on the link. The link can come free of its abutting position by pulling on the button, this pulling exerting on the link a sufficient tilting force that the link moves the moving element into a position in which it allows the link to tilt, to disengage from the abutting position, and then to slide longitudinally.

The connection between the control button and the link is preferably via a rod secured to the button, transverse to the movement of the button, and an opening pierced in the link, the rod passing through this opening.

The opening has a shape such that the link can tilt and such that the moving element of the switching member is pushed either by the link (to move towards the work position) or by the button (to free the link by the pushing of the button). For this, the opening preferably has a shape with two notches of different depths in which the rod of the button can be housed.

BRIEF DESCRIPTION OF THE DRAWINGS

Other features and advantages of the invention will become clear from reading the description of examples of a manual control system according to the invention, in which:

FIG. 3*c* is a sectional view of the manual control mechanism in the pulled-out position;

FIG. 4 is a sectional view of the manual control mechanism with a force $P_1$ being applied to the control button;

FIG. 4*a* shows the relative movement of a rod of the control button with respect to a link between the position of FIG. 3*c* and the position of FIG. 4;

FIG. 5 is a sectional view of the manual control mechanism in the pushed-in position;

FIG. 6 is a sectional view of the manual control mechanism in the pushed-in position;

FIG. 6*a* shows the relative movement of the rod with respect to the link between the position of FIG. 5 and the position of FIG. 6;

FIG. 7 is a sectional view of the manual control mechanism with the circuit breaker locked in the work position;

FIG. 8 is a sectional view of the manual control mechanism when a pulling force T is exerted on the control button;

FIG. 9 is a sectional view of the manual control mechanism in the pulled-out position;

FIG. 9*a* shows the relative movement of the rod with respect to the link between the position shown in FIG. 8 and the position shown in FIG. 9;

FIG. 10 is a sectional view of the manual control mechanism in the pushed-in position with a pressure $P_2$ applied to the control button;

FIG. 10*a* shows the relative movement of the rod with respect to the link between the position of FIG. 7 and the position of FIG. 10;

FIG. 11 is a sectional view of the manual control mechanism when the control button is pushed in to unlock the circuit breaker;

FIG. 12 is a sectional view of the manual control mechanism returning to the rest position under the force F of a first return spring; and FIG. 12*a* shows the relative movement between the rod and the link between the position in FIG. 11 and the position in FIG. 12.

DETAILED DESCRIPTION OF THE PREFERRED EMBODIMENTS

In the remainder of the description, an upper part or a lower part is to be understood as referring to an element when the system is in the position of the figures that aid this description.

Figure 1:
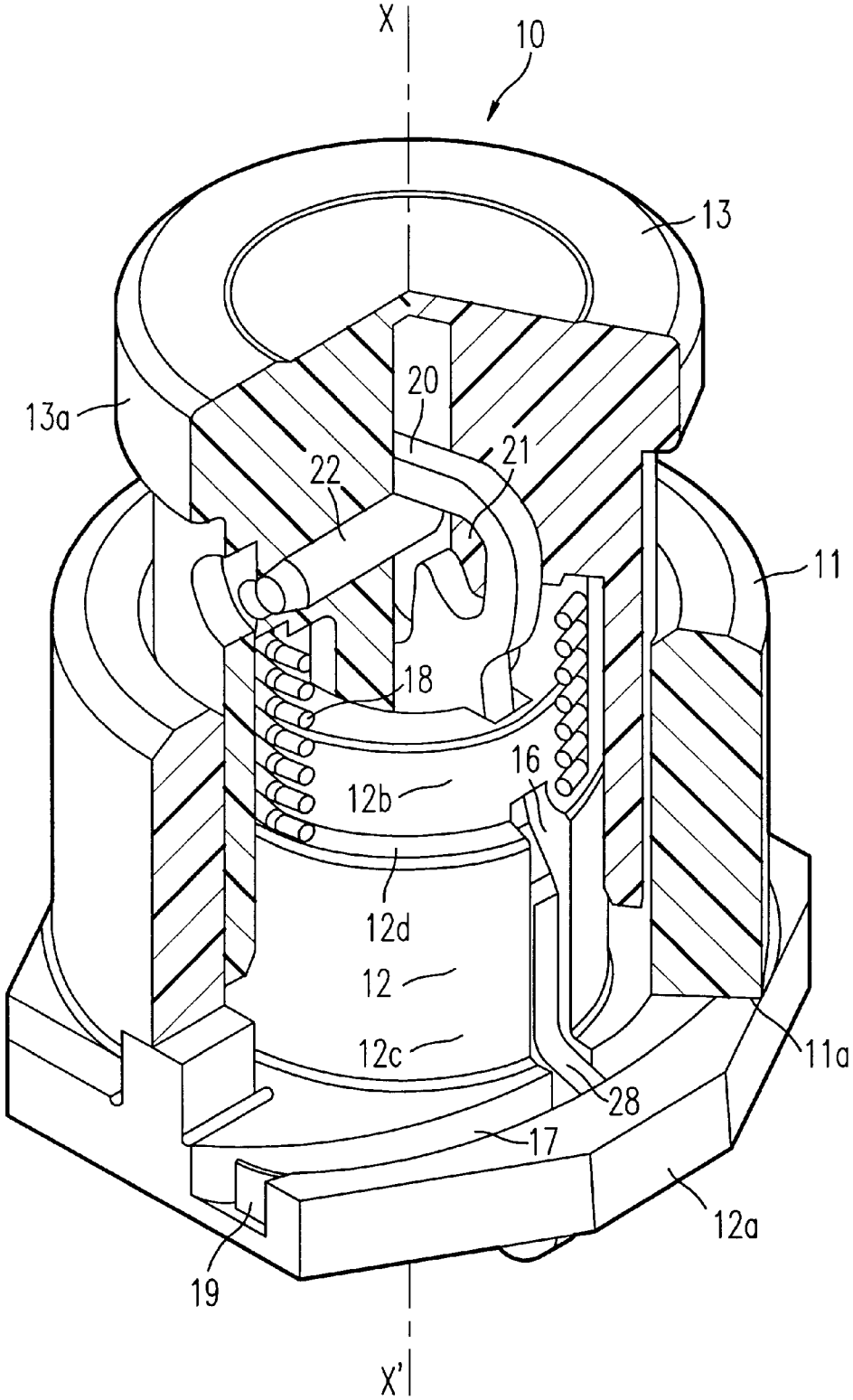
FIG. 1 depicts a partial cutaway view of the manual control mechanism in the pushed-in position.

A manual control system 10 depicted in perspective in FIG. 1, collaborating with the moving element of a circuit breaker (not depicted in FIG. 1) comprises:

a cylindrical bushing 11 of circular shape with axis XX' having, at its lower part, a base 11*a* in the form of a planar surface perpendicular to the axis of revolution XX' of the bushing 11;

a guide 12 with a cylindrical body of circular shape on the axis XX', the lower part of which comprises a shoulder 12*a* in a plane perpendicular to the axis of revolution XX' of the body. The body of the guide 12 comprises an upper part 12*b* and a lower part 12*c* which are contiguous. The diameter of the upper part 12*b* is smaller than the diameter of the lower part 12*c*, creating a cylindrical shoulder 12*d* of circular shape.

A first return spring 18 of helical shape is placed around the upper part 12*b* of the guide 12 and rests against the shoulder 12*d*. A first slot 16 lying in a plane passing through the axis XX' of the cylindrical body of the guide 12 allows a link 20 to move. A second slot 17 lying in the shoulder 12*a* and in a plane perpendicular to the plane in which the first slot 16 lies contains a second return spring 19, for example in the form of a leaf. The first slot 16 opens into the central region of the second slot 17, allowing the link 20 to be brought into contact with the second spring 19. The position of rest of the second spring 19 being the position that corresponds to its largest radius of curvature within the slot 17.

The bushing 11 and the guide 12 are mounted coaxially along the axis XX'. The base 11*a* of the bushing 11 being fixed by appropriate means to the shoulder 12*a* of the guide 12.

A cylindrical control button 13 of circular shape and axis XX' can move linearly in the upper part of the bushing 11 between the bushing 11 and the guide 12. The button 13 at its upper part has a larger part 13*a* making it easy to grasp hold of for pulling it. A rod 22 mounted perpendicularly to the axis XX' of the button 13 is secured to the button, for example by crimping.

The first spring 18 is compressed between the cylindrical shoulder 12*d* of the guide 12 and the button 13.

FIG. 1 shows the position of the mechanism in which position the link 20 exerts a force on the second spring 19 which is pushed against the outer wall of the second slot 17. The bushing 11 covers the second slot 17 of the guide 12, and a shoulder 28 of the link 20 lies under the base 11*a* of the bushing 11.

Figure 2B:
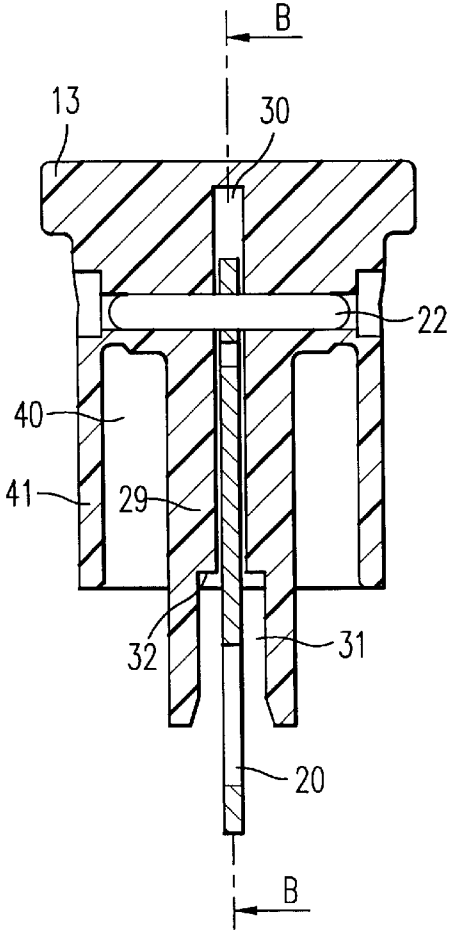
FIGS. 2*a* and 2*b* depict sectional views of the button, rod, and link subassembly.
Figure 2A:
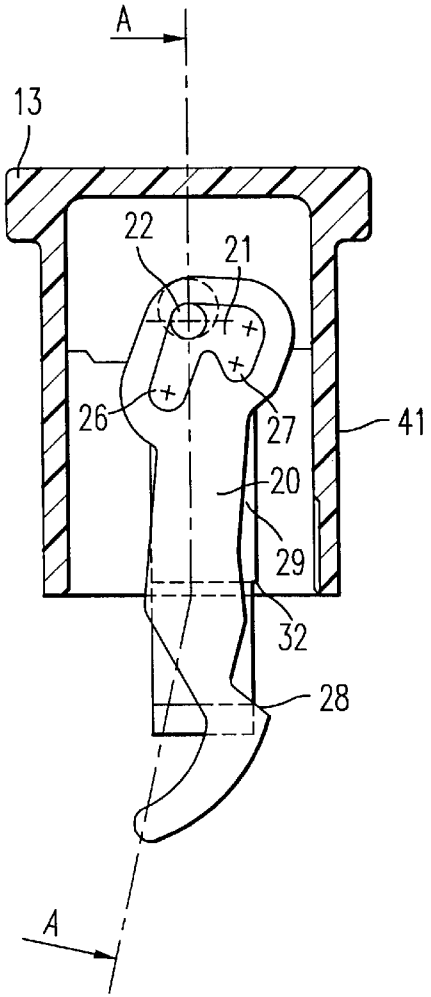

FIGS. 2*a* and 2*b* show two sections, respectively on axis B—B and on axis A—A of a subassembly that consists of the control button 13, the rod 22 and the link 20.

The link 20, of elongate shape (FIG. 2*a*), comprises in its upper part, an opening 21 which has a first notch 26 and a second notch 27 which have different depths. The lower part of the link 20 has the shape of half a pair of tongs allowing the moving element (not depicted in the figure) of the circuit breaker to be pushed or pulled and comprises a shoulder 28 allowing the mechanism 10 to be jammed in the work position of the circuit breaker.

The button 13 (FIG. 2*b*) comprises an outer wall 41 and an inner body 29 through which there passes, along the longitudinal axis of the button, a first slit 30 allowing the passage and guidance of the link 20 in the plane of this first slit 30. The first slit 30 is widened by a second slit 31 situated at the lower part of the inner body 29 to allow the passage of the upper part of the moving element of the switching member, not depicted in FIGS. 2*a* and 2*b*. A stop 32, created by the difference in width of the first slit 30 and of the second slit 31 will allow the pressure exerted on the control button 13 to be transmitted to the moving element of the circuit breaker. A space 40 of cylindrical shape situated between the inner body 29 and the wall 41 of the button 13 allows the passage of the guide 12 and of the first spring 18 (which are not depicted in FIGS. 2*a* and 2*b*).

The way in which the manual control system 10 works will now be described.

Figure 3A:
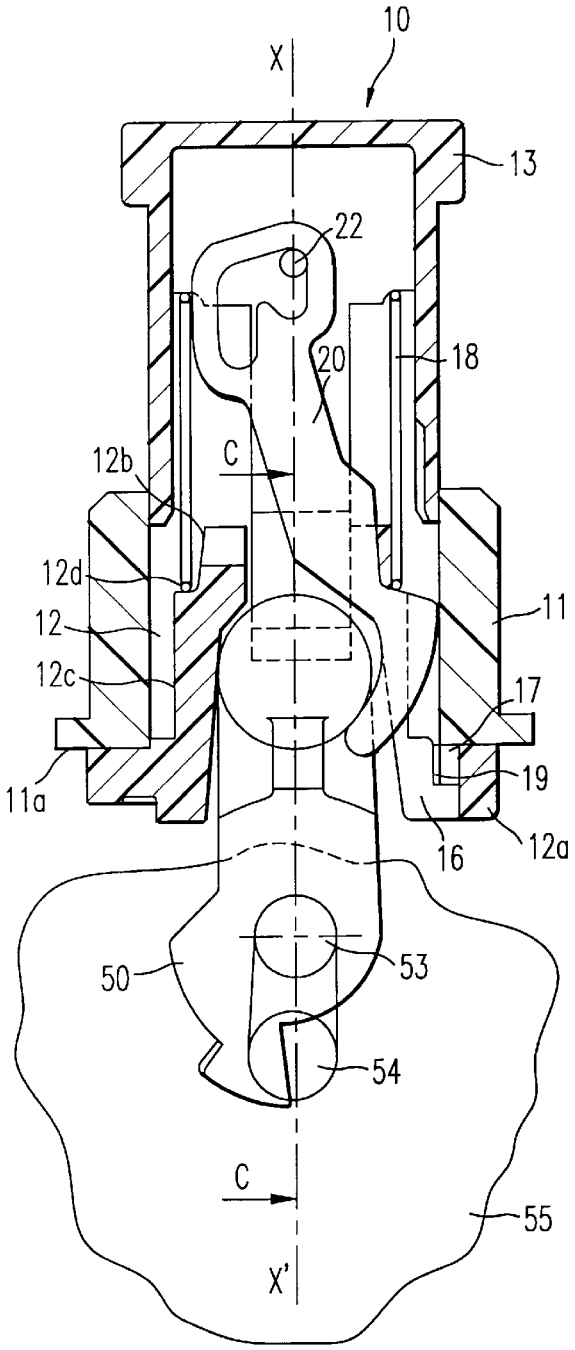
FIG. 3*a* is a simplified sectional view of the manual control mechanism in the pulled-out position.

The manual control system 10 (FIG. 1) works in conjunction with the moving control element of a circuit breaker (not depicted in FIG. 1), and in order to gain a better understanding of the interaction between the mechanism 10 and the moving element of the circuit breaker, FIG. 3*a* shows a simplified section on the plane of the link 20 of the manual control system 10 comprising the moving element 50 for controlling the circuit breaker assembly 55 in the scenario where the control button 13 is in the pulled-out position.

Figure 3B:
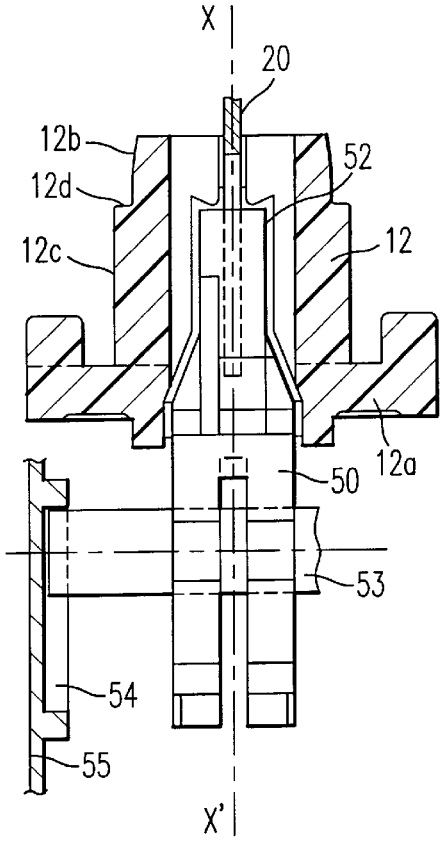
FIG. 3*b* is a simplified sectional view of the manual control mechanism in the pulled-out position.

FIG. 3*b* shows a simplified section on an axis C—C of the guide 12 with the moving element 50 for controlling the circuit breaker assembly 55. The guide 12 comprises a passage 52 allowing the upper part of the moving element 50 to be housed when the button 13 is in the pulled-out position.

The moving element 50 is equipped with a cylinder 53 moving either in the work position or in the position of rest, in a groove 54 provided for this purpose in the body of the circuit breaker assembly 55. The manually controlled mechanism 10 is secured to the body of the circuit breaker assembly 55 depicted partially in FIG. 3*b*.

FIG. 3*c* shows the button 13 in the pulled-out position, and the moving element 50 for controlling the circuit breaker assembly 55 is in the position of rest.

The first return spring 18 is compressed between the button 13 and the guide 12. The forces F exerted by the first spring 18 on the button 13 position the rod 22 secured to the button 13 so that it rests against the top part of the opening 21 in the link 20. In this position, the rod 22 exerts on the link 20 the force F1 and on the moving element 50 of the circuit breaker, a force F2 on the lower, tong-shaped part, of the link 20. The forces on the link are balanced by a third, reaction force F3 from the bushing 11, against which the link 20 presses.

Reference is made to FIG. 4:

Sufficient pressure $P_1$ is exerted in the direction of the axis XX' on the button 13 which moves in the bushing 11, compressing the first spring 18. The rod 22 drops into the second notch 27 of the opening 21 in the link 20. FIG. 4*a* shows the relative movement of the rod 22 of the button 13 with respect to the link 20 between the position of FIG. 3*c* and that of FIG. 4.

Reference is made to FIG. 5:

When the rod 22 comes to rest against the bottom of the notch 27, the movement of the button 13 is transmitted to the link 20 by the force F5 and to the moving element 50 of the switching member by the force F6. The pressure $P_1$ on the button 13 is exerted until the pin 53 comes into abutment against the bottom of the groove 54 provided in the body of the circuit breaker assembly 55. In this position, under the effect of the forces F5 and the reaction force F'6 which are exerted on the link by the rod 22 and the moving element 50 respectively, the link tilts under the bushing 11, into the second slot 17 of the guide 12, compressing the second spring 19. A force F4 exerted by the second spring 19, compressed onto the outer wall of the second slot 17, keeps the link in a position of equilibrium.

Reference is made to FIG. 6:

The pressure on the button 13 is released. The circuit breaker is brought into the work position and a permanent force F7 is exerted on the link 20 by the circuit breaker through the moving element 50. This causes the link 20 to tilt about the rod 22 of the button 13 which adopts a new position at the height of the notch 26 in the opening 21 of the link 20 and causes the mechanism to lock by the anchoring of the shoulder 28 of the link under the bushing 11 (force F8).

FIG. 6*a* shows the relative movement of the rod 22 with respect to the link 20 between the position of FIG. 5 and that of FIG. 6.

FIG. 7 shows the button 13 in the pushed-in position.

As the link 20 is in the jammed position, the force F9 on the rod 22 balances the return forces F exerted by the spring 18 on the button 13. The circuit breaker is locked in the work position.

Starting from this stable position characterized by a pushed-in position of the button 13 for controlling the manually operated mechanism 10 and the circuit breaker being locked in the work position, one of two possible actions can be chosen for unlocking the circuit breaker and returning it to its position of rest which is characterized by the button 13 for controlling the manually operated mechanism 10 being in a pulled-out position.

First possible action:

Reference is made to FIG. 8:

Starting from the stable position of FIG. 7, a pulling force T is exerted on the button 13 in the direction of the axis XX'. This force is transmitted to the link 20 by the rod 22 of the button 13 via the force F10. When this force becomes greater than the resisting force of the shoulder 28 of the link 20 being anchored under the bushing 11, the link, disengaging from the second slot 19, transmits the pulling force F10 exerted by the button 13 on the link to the moving element 50. The tong-shaped lower part of the link pulls the moving element 50 (force F11). This action causes the circuit breaker to tilt into its position of rest.

Reference is made to FIG. 9:

The pulling force on the button 13, or simply the force of the first spring 18 on the button 13 when the mechanism is disengaged, causes the link 20 to tilt and the system is returned to its initial position. The button finds itself once more in the pulled-out position and the circuit breaker in the position of rest, as depicted in its initial position in FIG. 3*c*.

FIG. 9*a* shows the relative movement of the rod 22 with respect to the link 20 between the position of FIG. 8 and that of FIG. 9.

Second possible action:

Reference is made to FIG. 10:

Starting from the stable position of FIG. 7, pressure P2 is exerted on the button 13 in the direction of the axis XX', the rod 22 drops into the notch 26 of the opening 21 in the link 20. The link is held in position by the force F12 exerted by the moving element 50.

The stop 32 on the inner body 29 of the button 13 comes into contact with the upper part of the moving element 50 (force F13).

FIG. 10*a* shows the relative movement of the rod 22 with respect to the link 20 between the position of FIG. 7 and that of FIG. 10.

Reference is made to FIG. 11:

The pressure P2 exerted on the button 13 is transmitted by the stop 32 of the body 29 of the button 13 to the upper part of the moving element 50 (force F13), moving it towards the lower part of the guide 12 until the cylinder 53 comes into abutment in the lower part of the groove 54 of the body of the circuit breaker assembly 55.

In this position of the manually controlled mechanism 10, the force F12 (see FIG. 10) exerted by the moving element 50 on the link 20 disappears and the second return spring 19 exerting the force F14 on the link 20, pushes it out of the second slot 17 of the guide 12. The shoulder 28 of the link 20 comes disengaged from its anchorage under the bushing 17.

Reference is made to FIG. 12:

The pressure P2 on the button 13 is released. The return forces F exerted by the first spring 18 lends to return the button 13 towards its pulled-out position. A pulling force F15 is exerted by the rod 22, secured to the button 13, on the link 20.

The pulling force F15 is transmitted by the half pair of tongs from the link 20 to the moving element 50 of the circuit breaker assembly 53 in the form of a force F16 which pulls the moving element 50 towards the upper part of the guide 12 towards its initial position of rest. The link 20 moves in the bushing 11 which exerts a reaction force F17 on the link 20, keeping it in contact with the moving element 50 as it moves in the guide 12. FIG. 12*a* shows the relative movement of the rod 12 with respect to the link 20 between the position of FIG. 11 and that of FIG. 12.

The new position of the manually controlled mechanism 10 is identical to the one depicted in FIG. 8, causing the link to tilt into the position shown in FIG. 9.

FIG. 9*a* shows the relative movement of the rod 22 with respect to the link 20 between the position of FIG. 8 and that of FIG. 9.

The manual control system 10 is returned to its initial position of FIG. 3*c*. The button 13 finds itself once again in the pulled-out position, and the switching member in the position of rest.

We claim:

1. A mechanism for manually controlling an electric switching member, comprising:

a control button;

a guide configured to guide the movement of a moving element of the electric switching member between a position of rest and a work position;

a link configured to move longitudinally in a direction of travel of the control button and configured to tilt into an abutting position that prevents longitudinal movement of the link;

a button element coupled to the control button and configured to contact the link to transfer to the link a force applied to the button;

a first return spring configured to push the control button into a pulled-out position;

a second return spring configured to push the link out of the abutting position; and a bushing defining a space in which the control button slides and in which an upper portion of the link is positioned.

2. A mechanism according to claim 1, wherein the link is configured to push the moving element into the work position and pull the moving element into the position of rest.

3. A mechanism according to claim 2, wherein a lower portion of the link forms a tong configured to pull and push the moving element.

4. A mechanism according to claim 1, wherein the link comprises:

a shoulder configured to jam the link in the abutting position.

5. A mechanism according to claim 1, wherein the upper portion of the link has an opening configured to allow the link to tilt, the button element being positioned in the opening.

6. A mechanism according to claim 5, wherein the opening forms a first notch configured to receive the button element and a second notch configured to receive the button element, the first notch and the second notch having different depths.

7. A mechanism according to claim 1, wherein the guide is coupled to the bushing.

8. A mechanism according to claim 7, wherein the guide comprises:

a shoulder abutting a lower portion of the first return spring;

a first slot in which the link moves;

a second slot in which the second return spring is positioned.

9. A mechanism according to claim 8, wherein the first slot opens into the second slot and the link is configured to contact the second return spring.

10. A mechanism according to claim 8, wherein the guide comprises:

an upper cylindrical portion; and a lower cylindrical portion having a diameter larger than the upper cylindrical portion, the shoulder being formed between the upper cylindrical portion and the lower cylindrical portion.

11. A mechanism according to claim 8, wherein the bushing covers the second slot of the guide and the first shoulder is configured to jam in abutment against a lower portion of the bushing.

12. A mechanism according to claim 1, wherein the first return spring comprises:

a helical spring.

13. A mechanism according to claim 11, wherein the second return spring comprises:

a leaf spring.

14. A mechanism according to claim 11, wherein the control button is configured to move linearly between the bushing and the guide.

15. A mechanism according to claim 14, wherein the control button is cylindrical and has a longitudinal axis.

16. A mechanism according to claim 14, wherein the control button comprises:

an inner body defining a first slit along the longitudinal axis, the upper portion of the link being positioned within the first slit.

17. A mechanism according to claim 16, wherein the inner body defines a second slit along the longitudinal axis, said second slit being configured to receive the moving element of the electric switching member.

18. A mechanism according to claim 1, wherein the button element comprises:

a rod.

19. A mechanism according to claim 1, wherein the moving element is the moving element of a circuit breaker.

20. A mechanism according to claim 2, wherein the link comprises:

a shoulder configured to jam the link in the abutting position.

* * * * *

UNITED STATES PATENT AND TRADEMARK OFFICE

CERTIFICATE OF CORRECTION

PATENT NO. : 6,103,983
DATED : August 15, 2000
INVENTOR(S) : Bernard Truchet, et al.

It is certified that error appears in the above-identified patent and that said Letters Patent is hereby corrected as shown below:

On the Title Page, Item [54, and Column 1, the Title is incorrect. The Title should read as follows;

--[54] PUSH BUTTON OPERATING MECHANISM FOR A SWITCHING ELEMENT INCLUDING PUSH-PUSH AND PUSH-PULL FEATURES

Signed and Sealed this

Second Day of October, 2001

*Attest:*

Nicholas P. Godici

*Attesting Officer*

NICHOLAS P. GODICI
*Acting Director of the United States Patent and Trademark Office*